US007881653B2

(12) United States Patent
Izuchi

(10) Patent No.: US 7,881,653 B2
(45) Date of Patent: Feb. 1, 2011

(54) IMAGE RECORDING APPARATUS

(75) Inventor: Masatoshi Izuchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 874 days.

(21) Appl. No.: 11/769,010

(22) Filed: Jun. 27, 2007

(65) Prior Publication Data

US 2008/0013999 A1 Jan. 17, 2008

(30) Foreign Application Priority Data

Jun. 30, 2006 (JP) ..... 2006-181779

(51) Int. Cl.
*G03G 15/00* (2006.01)

(52) U.S. Cl. ..... 399/393; 399/388; 399/23; 399/114; 271/10.01; 271/10.04; 271/157; 271/164; 271/167; 271/258.05; 400/691; 400/692; 400/693

(58) Field of Classification Search ..... 399/388, 399/393, 23, 114; 271/10.01, 10.04, 258.05, 271/157, 164, 167; 400/691, 692, 693
See application file for complete search history.

(56) References Cited

U.S. PATENT DOCUMENTS

| | | | | |
|---|---|---|---|---|
| 5,897,110 | A | 4/1999 | Fujiwara | |
| 6,792,230 | B2 * | 9/2004 | Saito et al. | 399/111 |
| 2003/0209851 | A1 * | 11/2003 | Shin | 271/126 |
| 2005/0158111 | A1 * | 7/2005 | Yang | 400/624 |
| 2006/0071399 | A1 | 4/2006 | Asada et al. | |

FOREIGN PATENT DOCUMENTS

| | | | |
|---|---|---|---|
| JP | S56-029043 | U | 3/1981 |
| JP | H05-278873 | A | 10/1993 |
| JP | H05-085744 | U | 11/1993 |

(Continued)

OTHER PUBLICATIONS

Japan Patent Office, Notification of Reason for Refusal for Japanese Patent Application No. 2006-181779 (counterpart to above-captioned patent application), mailed Nov. 16, 2010.

*Primary Examiner*—Judy Nguyen
*Assistant Examiner*—Andy L Pham
(74) *Attorney, Agent, or Firm*—Baker Botts L.L.P.

(57) ABSTRACT

An image recording apparatus including: a body; a supply tray attached to the body for putting a recording sheet thereon; a recording mechanism provided in a middle of a feed path defined in the body for recording an image on the recording sheet; a feeding mechanism which has an arm pivotably supported at one of opposite ends thereof and a feeding roller rotatably provided in the other of the opposite ends of the arm, and which is configured such that the recording sheet is fed toward the recording mechanism by rotating of the feeding roller held in contact with the recording sheet; a discharge opening provided in the body for discharging the recording sheet therethrough; a cover supported by the body to be pivotable between an open position and a closed position; and a cover-arm interlock mechanism which permits the arm to pivot such that the feeding roller contacts the recording sheet when the cover is positioned at the open position, and which positions the arm such that the feeding roller is away from the recording sheet when the cover is positioned at the closed position.

10 Claims, 9 Drawing Sheets

FOREIGN PATENT DOCUMENTS

| | | | | |
|---|---|---|---|---|
| JP | 9058881 | A | | 3/1997 |
| JP | H10-231031 | A | | 9/1998 |
| JP | 11001045 | A | * | 1/1999 |
| JP | 11005634 | A | | 1/1999 |
| JP | 2002-019975 | A | | 1/2002 |
| JP | 2004-196526 | A | | 7/2004 |
| JP | 2006-082919 | A | | 3/2006 |

* cited by examiner

IMAGE RECORDING APPARATUS

The present application is based on Japanese Patent Application No. 2006-181779 filed on Jun. 30, 2006, the contents of which are incorporated herein by reference.

BACKGROUND OF THE INVENTION

1. Field of the Invention

The present invention relates to an image recording apparatus in which a recording sheet put on a supply tray is fed therefrom and an image is recorded on the same sheet.

2. Discussion of Related Art

Generally, in a conventional image recording apparatus, recording sheets put on a sheet-supply tray are fed into a feed path one by one. An image is recorded, by an image recording mechanism provided in the feed path, on a recording sheet that has been fed into the feed path. Then, the recording sheet (on which the image has been recorded) is discharged into a sheet-discharge tray.

In a conventional image recording apparatus disclosed by Japanese Unexamined Patent Application Publication No. 11-5634, there is adopted a cassette-type sheet-supply tray which is attachable to and detachable from a device body, such that the cassette-type sheet supply tray on which the recording sheets are put is to be attached thereto. The recording sheets put on the cassette-type sheet-supply tray are fed into the feed path one by one, owing to a sheet-feeding roller which is held in contact with an uppermost one of the recording sheets and which is rotated. When the cassette-type sheet supply tray is detached from the device body, a whole operation of the same apparatus is stopped for safety.

SUMMARY OF THE INVENTION

However, in the above-described conventional image recording apparatus, the sheet-supply tray is temporarily detached from the device body when the sheet-supply tray is refilled with the recording sheets. After the sheet-supply tray is refilled (namely, the recording sheets are charged), the sheet-supply tray is attached to the device body again. In other words, it is difficult to charge the recording sheets in a state in which the sheet-supply tray is attached to the device body because the sheet-feeding roller is in contact with the uppermost one of the recording sheets stacked on the sheet-supply tray. More specifically, in this arrangement, the recording sheets as a refill need to be inserted through a space between the stacked recording sheets and the sheet-feeding roller that is biased to contact with the recording sheets if the sheet-supply tray is refilled with the recording sheets in the state in which the sheet-supply tray is attached to the device body. The recording sheets could be bent when charged if a biasing force of the sheet-feeding roller is strong or each recording sheet is not stiff. Therefore, the recording sheets are blocked by the sheet-feeding roller when inserted, whereby it is difficult to charge the recording sheets.

The present invention has been developed in view of the background discussed above. It is therefore an object of the present invention to provide an image recording apparatus in which recording sheets can be easily charged even when a sheet-supply tray is attached to a device body.

To achieve the above-described object and to solve the above-described problem, a following arrangement is adapted for the present invention.

An image recording apparatus according to the present invention includes: a body; a supply tray which is attached to the body and on which a recording sheet is put; a recording mechanism which is provided in a middle of a feed path defined in the body, and which records an image on the recording sheet fed along the feed path from the supply tray; a feeding mechanism which includes (a) an arm pivotably supported at one of opposite ends thereof and (b) a feeding roller rotatably provided in the other of the opposite ends of the arm, and which is configured such that the recording sheet is fed toward the recording mechanism by rotating of the feeding roller held in contact with the recording sheet put on the supply tray; a discharge opening which is provided in the body and through which the recording sheet is discharged from the recording mechanism; a cover which is supported by the body so as to be pivotable between an open position at which the discharge opening is open and a closed position at which the discharge opening is closed; and a cover-arm interlock mechanism which permits the arm to pivot such that the feeding roller contacts the recording sheet put on the supply tray when the cover is positioned at the open position, and which positions the arm such that the feeding roller is away from the recording sheet put on the supply tray when the cover is positioned at the closed position.

In the image recording apparatus according to the present invention, the cover is provided so as to be pivotable between the open position and the closed position. According to pivoting of the cover, the linking member swings whereby the arm is pivoted. Thus, when the cover is positioned at the closed position, the feeding roller is separated from the recording sheet put on the supply tray so that the recording sheet can be easily charged. When the cover is positioned at the open position, the feeding roller is held in contact with the recording sheet put on the supply tray so that the recording sheet can be fed.

BRIEF DESCRIPTION OF THE DRAWINGS

The above and optional objects, features, and advantages of the present invention will be better understood by reading the following detailed description of preferred embodiments of the invention when considered in conjunction with the accompanying drawings, in which.

DETAILED DESCRIPTION OF THE PREFERRED EMBODIMENTS

Figure 1:
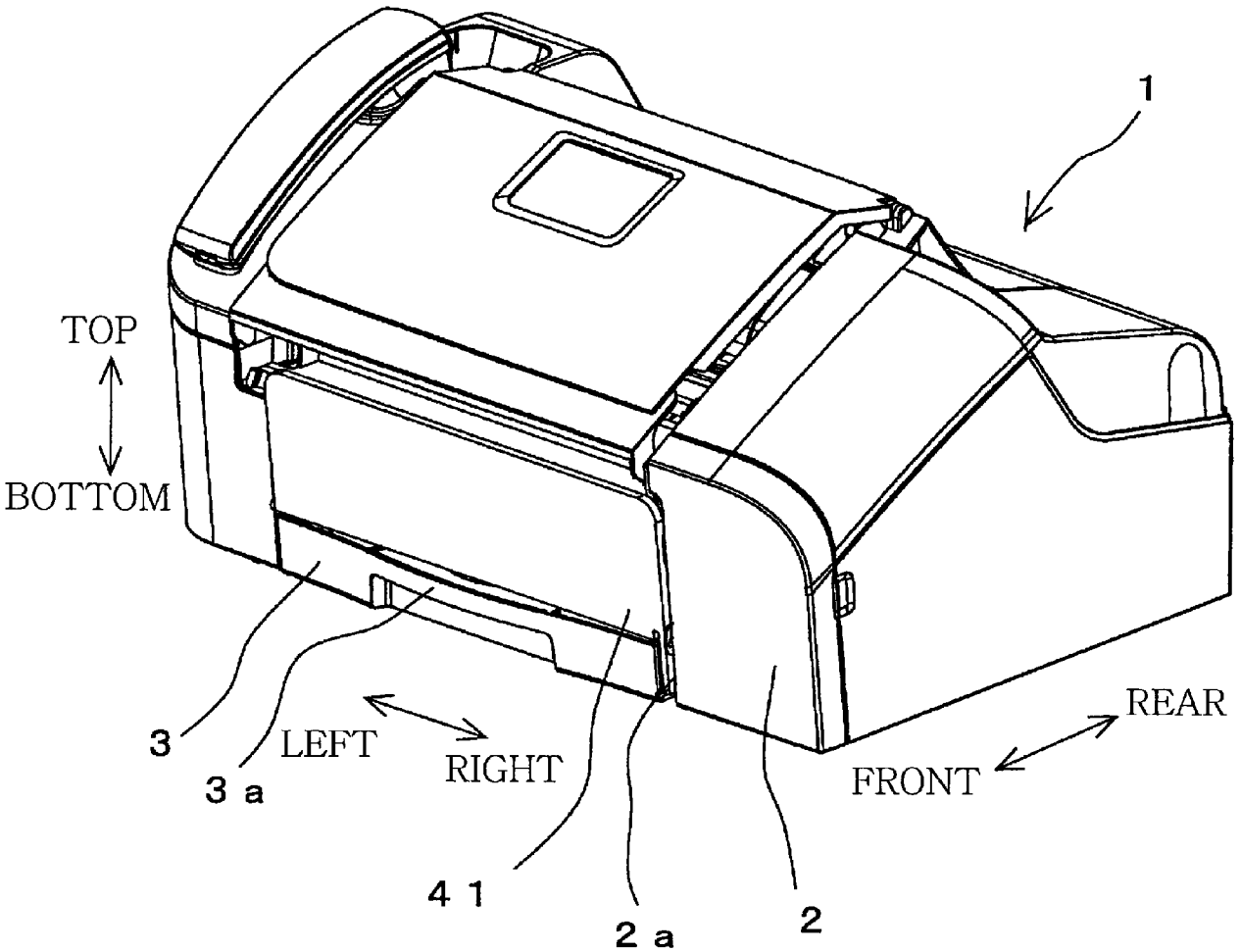
FIG. 1 is a perspective view showing an exterior configuration of a Multi Function Device (MFD) as an embodiment of the present invention in a state in which a cover is positioned at a closed position and a sheet-supply tray is having a stay-in posture.
Figure 2:
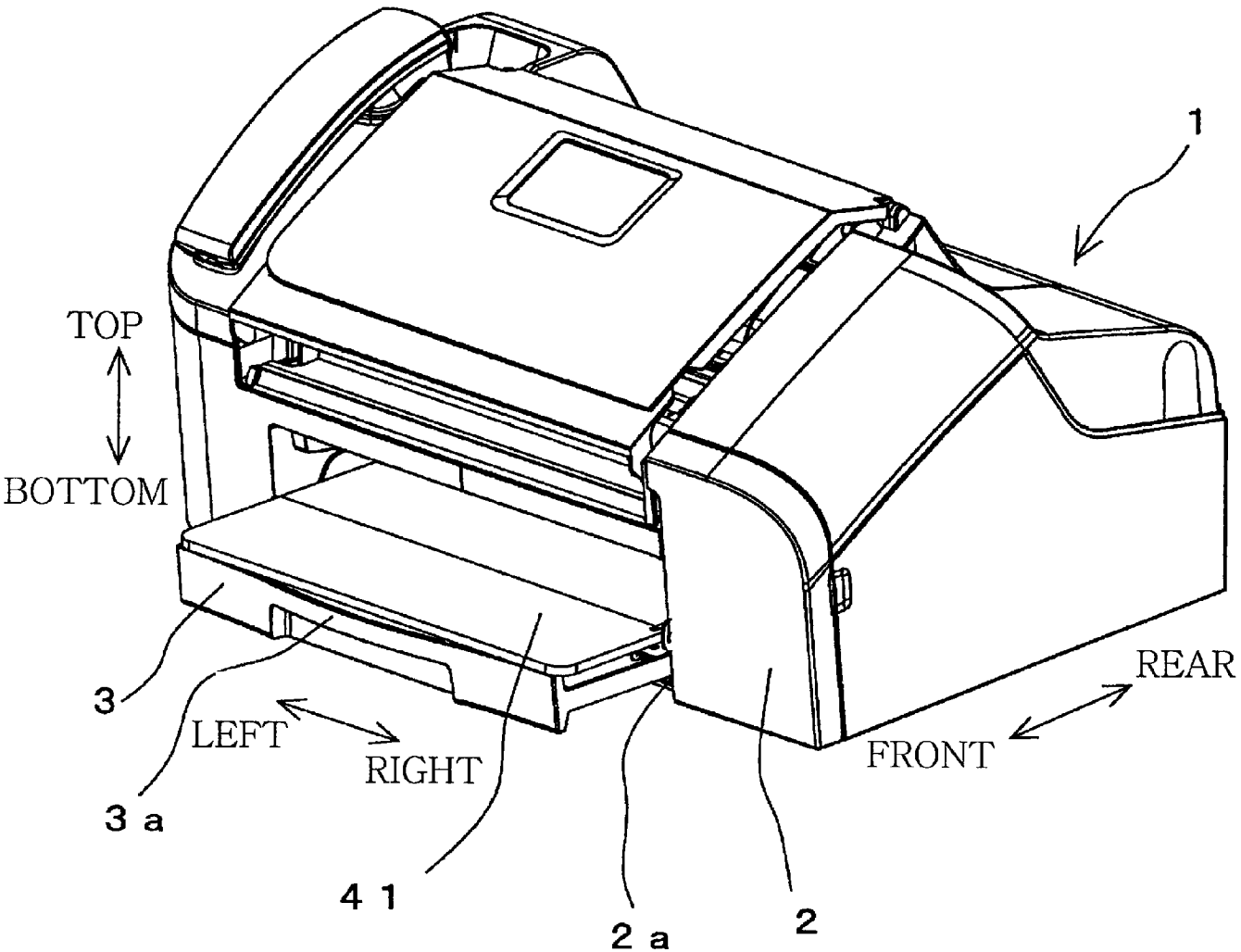
FIG. 2 is a perspective view showing the exterior configuration of the MFD in a state in which the cover is positioned at an open position and the sheet-supply tray is having a projecting posture.
Figure 3:
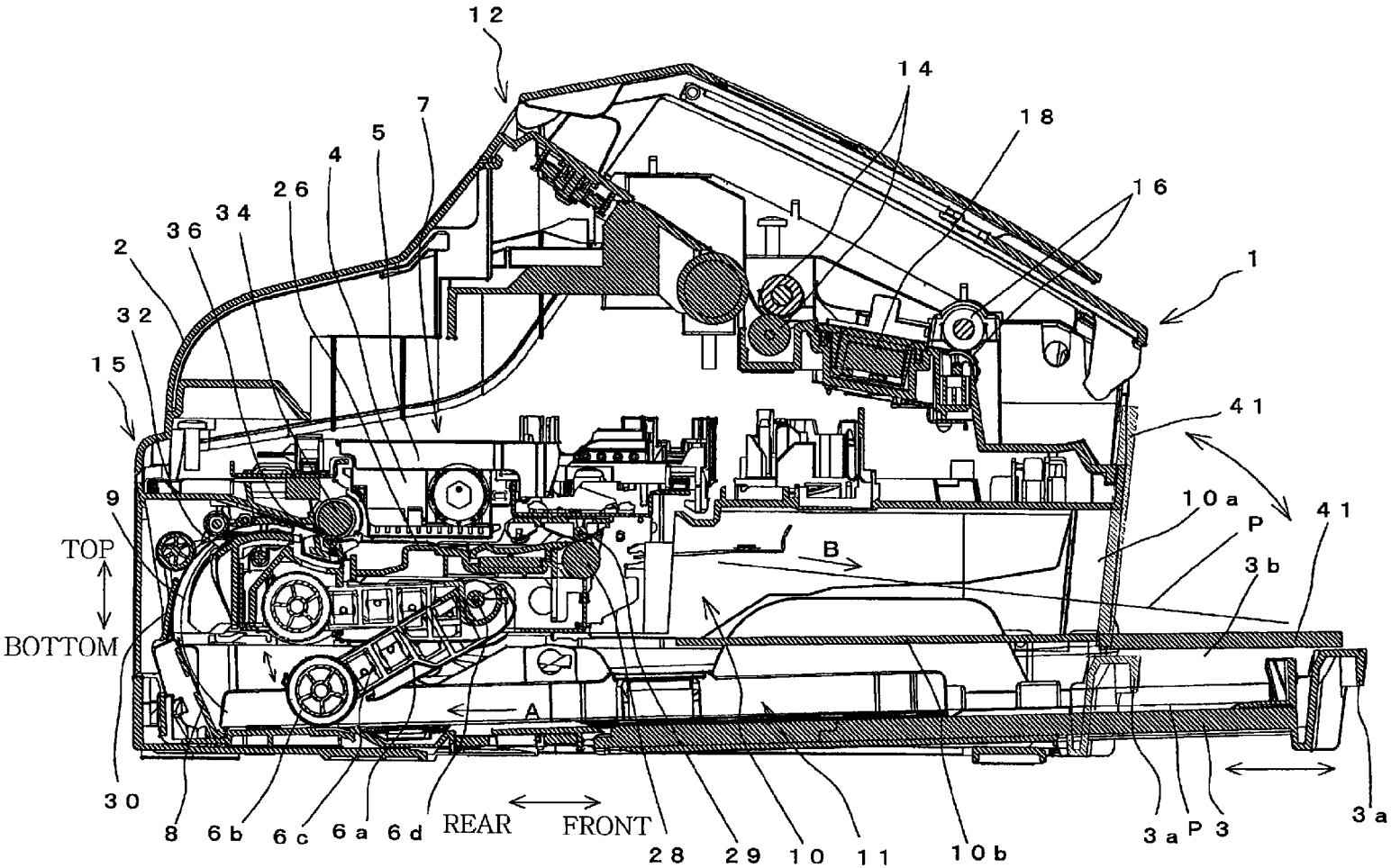
FIG. 3 is an enlarged cross-sectional side view of the MFD.

Hereinafter, there will be described a first preferred embodiment of the present invention by reference to the drawings. FIG. 1 is a perspective view showing an exterior configuration of an MFD (i.e., Multi Function Device) 1 including an image recording device 15 when a cover 41 is positioned at a closed position and a sheet-supply tray 3 is having a stay-in posture. FIG. 2 is a perspective view showing the exterior configuration of the MFD 1 when the cover 41 is positioned at an open position and the sheet-supply tray 3 is having a projecting posture. FIG. 3 is an enlarged cross-sectional side view of the MFD 1 in the state shown in FIG. 2. It is noted that, in the following description, there will be used terms "upward", "downward", "rightward", "leftward", "frontward" and "rearward" directions of the MFD 1 that are indicated by respective arrows "TOP", "BOTTOM", "RIGHT", "LEFT", "FRONT" and "REAR" in FIGS. 1 and 2. That is, the later-described sheet-supply tray 3 is provided in a front portion of the MFD 1. Right and left portions of the MFD 1 are located in right and left sides, respectively, as seen from an user who is in a front side of the MFD 1.

The MFD 1 has an image-recording function, an image-reading function, a color-copy function, and a facsimile function, etc. As shown in FIGS. 1-3, in the MFD 1, an image reading device 12 for reading an image from an original document is provided on an upper part of a device body 2 that is made from a synthetic resin.

In the image reading device 12 which is configured to be a sheet-feed type, the original document is fed by a pair of document-feeding rollers 14, 14 and a pair of document-discharging rollers 16, 16. Then, the image of the original document is read by a Contact Image Sensor (CIS) 18 interposed between the document-feeding rollers 14, 14 and the document-discharging rollers 16, 16 for reading the image of the original document. Based on an image data of the image read by the CIS 18, an image signal is outputted. It is noted that each of the pairs of rollers 14, 16 is provided by an upper roller and a lower roller that is disposed below the upper roller.

In the device body 2 below the image reading device 12, the image recording device 15 is provided. On a bottom part of the device body 2, there is provided a sheet-supply section 11 for supplying a sheet P as a recording medium. In the sheet-supply section 11, there is provided the sheet-supply tray 3 which has a box-like shape opening upwardly and which accommodates sheets P therein. The sheet-supply tray 3 is attachable to and detachable from the device body 2 via an opening 2*a* in the forward and rearward direction.

In the present embodiment, the sheet-supply tray 3 is configured to be capable of accommodating a plurality of sheets P with variety of sizes, e.g., an A-4 size, a letter size, a legal size, and a postcard size, in a state in which a short side (i.e., a width) of the sheets P extends in a direction (i.e., the rightward and leftward direction) perpendicular to a feed direction (i.e., the frontward and rearward direction, or an arrow A direction indicated in FIG. 3). It is noted that, in the present embodiment, "the sheet P" may include not only a paper but any feedable materials such as a resin, a metal, and etc., as long as the image can be recorded thereon.

As shown in FIG. 3, in a rear part of the device body 2 (i.e., behind the sheet-supply tray 3), there is provided a slant sheet-separate plate 8 which projects at a middle portion thereof in a widthwise direction of the sheet P (i.e., the rightward and leftward direction) and retracts as extending toward opposite directions which corresponds to right and left ends of the sheet P as seen in the widthwise direction thereof so as to have a curved convex shape in a plan view. In the middle portion of the slant sheet-separate plate 8 in the widthwise direction of the sheet P, a serrated elastic separation pad (not shown) is provided for separating an uppermost one of the sheets P by contacting a leading end thereof.

In the sheet-supply section 11, an arm 6*a* for supplying the sheet P from the sheet-supply tray 3 is supported, at one of opposite ends thereof, by the device body 2, so as to be vertically pivotable about a support shaft 6*d* which extends in a direction in parallel to a widthwise direction of the sheet P. At the other of the opposite ends of the arm 6*a*, a sheet-feeding roller 6*b* is rotatably supported. Owing to a gear transmission mechanism 6*c* provided in the arm 6*a*, a rotational driving force is transmitted from a feed motor (not shown) to the sheet-feeding roller 6*b*.

The arm 6*a* makes the sheet-feeding roller 6*b* contact the uppermost one of the sheets P put on the sheet-supply tray 3, owing to a biasing force by a self-weight of the sheet-feeding roller 6*b*, a spring (not shown), and so on. Then, the sheet-feeding roller 6*b* and the above-described slant sheet-separate plate 8 cooperate to separate and feed the sheets P stacked on the sheet-supply tray 3 one by one. It is noted that a feeding mechanism is constituted by the arm 6*a* and the sheet-feeding roller 6*b*.

The sheet P which has been separated is fed into, in the feed direction (i.e., in the arrow A direction indicated in FIG. 3), and fed along a feed path 9 which is defined as a space between a first feed-path-defining member 30 and a second feed-path-defining member 32 so as to have a U-turn shape, and then fed to an image recording mechanism 7 provided above the sheet-supply tray 3.

The image recording mechanism 7 includes an inkjet-type recording head 4, a carriage 5 and a platen 26. The recording head 4 is configured to record the image onto the sheet P by ejecting an ink from its bottom surface. The carriage 5 is equipped with the recording head 4 and reciprocatable in a direction perpendicular to a drawing sheet of FIG. 3. In the image recording mechanism 7, below the recording head 4 mounted on the carriage 5, there is provided the platen 26 which has a flat shape extending in the rightward and leftward direction and which supports a lower surface of the sheet P such that an upper surface of the sheet P faces the recording head 4.

As shown in FIG. 3, in an upstream side of the platen 26 in a sheet-discharge direction (i.e., in an arrow B direction indicated in FIG. 3), there are disposed a drive roller 34 and a nip roller 36 each of which functions as a registering roller for registering or carrying the sheet P onto an upper surface of the platen 26 (namely, below the recording head 4). The nip roller 36 is provided below the drive roller 34 so as to face the drive roller 34. In a downstream side of the platen 26 in the sheet-discharge direction (i.e., in the arrow B direction indicated in FIG. 3), there are disposed a sheet-discharging roller 28 and a spur roller 29. The sheet-discharging roller 28 is driven to rotate such that the sheet P, which has passed through the image recording mechanism 7, is carried in the sheet-discharge direction to a sheet-discharge section 10. The spur roller 29 is provided so as to face, and biased toward, the sheet-discharging roller 28.

In the sheet-discharge section 10 provided above the sheet-supply section 11, the sheet P on which the image has been recorded in the image recording mechanism 7 is discharged, with its recording surface being as an upper surface. Further, in the sheet-discharge section 10, a sheet-discharge opening 10*a* opens in the opening 2*a* formed in the front face of the MFD 1 (i.e., a front face of the device body 2). The sheet P, which is discharged from the sheet-discharge section 10 in the sheet-discharge direction (i.e., in the arrow B direction indicated in FIG. 3), is stacked and accommodated in a sheet-discharge tray 10*b* positioned behind the opening 2*a*.

On a front face of the sheet-supply tray 3, a pull portion 3*a* is provided and the sheet-supply tray 3 is telescopic in a direction parallel to a lengthwise direction of the sheets P put on the sheet-supply tray 3. More specifically, by pulling the pull portion 3*a* of the sheet-supply tray 3 frontward, the sheet-supply tray 3 changes its figure from a stay-in posture (in which an entirety of the sheet-supply tray 3 stays in the device body 2 such that the front face of the sheet-supply tray 3 is almost flush with the front face of the device body 2, as shown in FIG. 1) to a projecting posture (in which a portion of the sheet-supply tray 3, i.e., a projecting portion, projects outward and frontward from the device body 2 such that an opening 3*b* opening upward is formed, as shown in FIG. 2). Thus, the sheet-supply tray 3 is telescopic. It is noted that, in FIG. 3, the pull portion 3*a* of the sheet-supply tray 3 in the stay-in posture is indicated by a thin line.

In the present embodiment, when the sheet-supply tray 3 is having the projecting posture, the A-4 size sheets P can be put on the sheet-supply tray 3. In this instance, a portion of the A-4 size sheets P is exposed via the opening 3*b* of the sheet-supply tray 3.

On the front face of the device body 2, the cover 41 is pivotably supported. The cover 41 has a generally flat-plate shape. A width of the cover 41 as measured in the rightward and leftward direction is almost the same as a width of the opening 2*a* as measured in the rightward and leftward direction. The opening 3*b* of the sheet-supply tray 3 is provided in an almost same position as a position of the sheet-discharge opening 10*a* of the sheet-discharge section 10 in the rightward and leftward direction. The opening 3*b* and the sheet-discharge opening 10*a* open upward and frontward, respectively, so that an angle of about 90 degrees is defined between the opening 3*b* and the sheet-discharge opening 10*a*.

Figure 4:
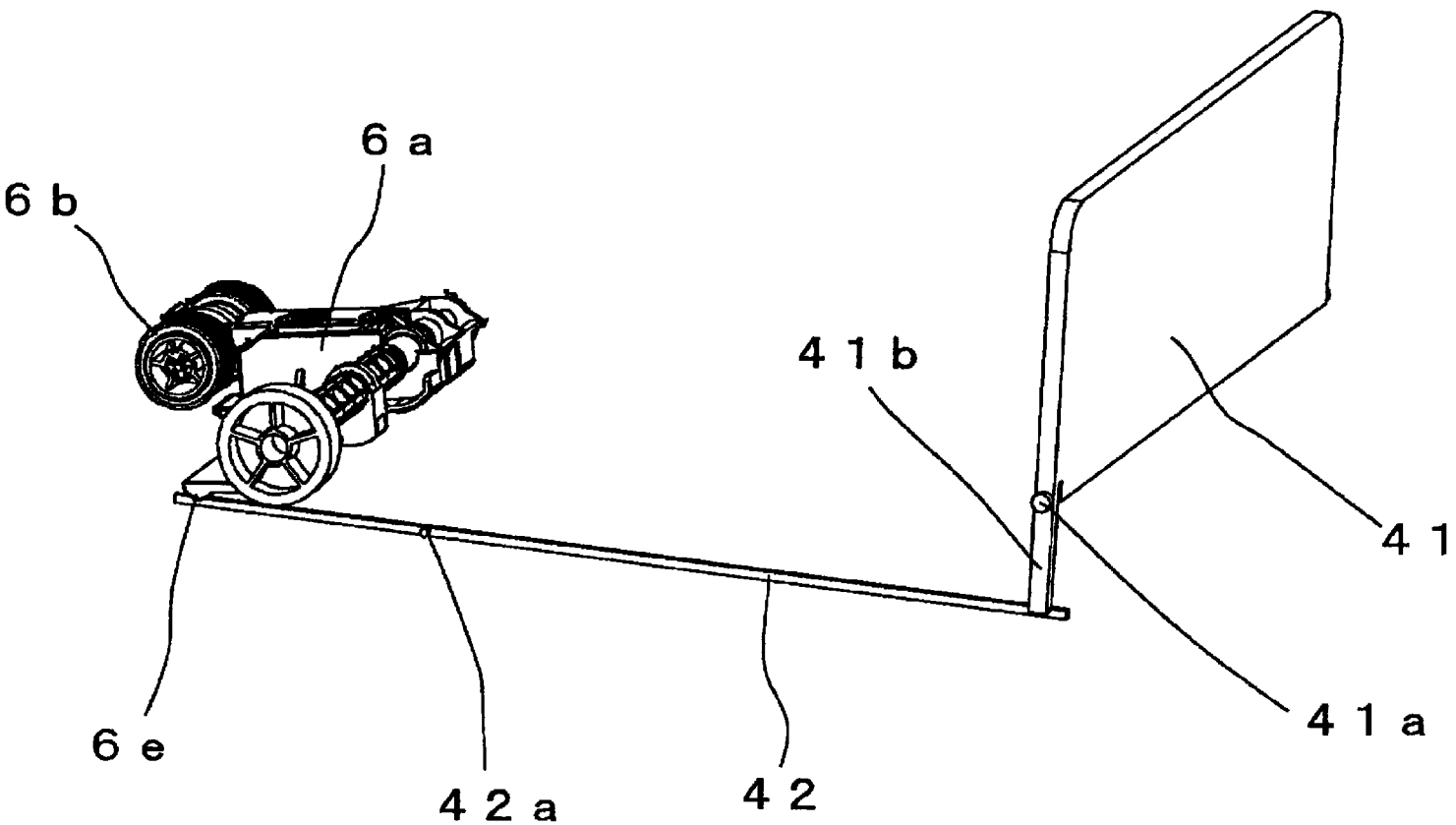
FIG. 4 is a perspective view showing the cover, a linking member, an arm, and a sheet-feeding roller which are provided in the MFD 1 as a first embodiment of the present invention.
Figure 5A:
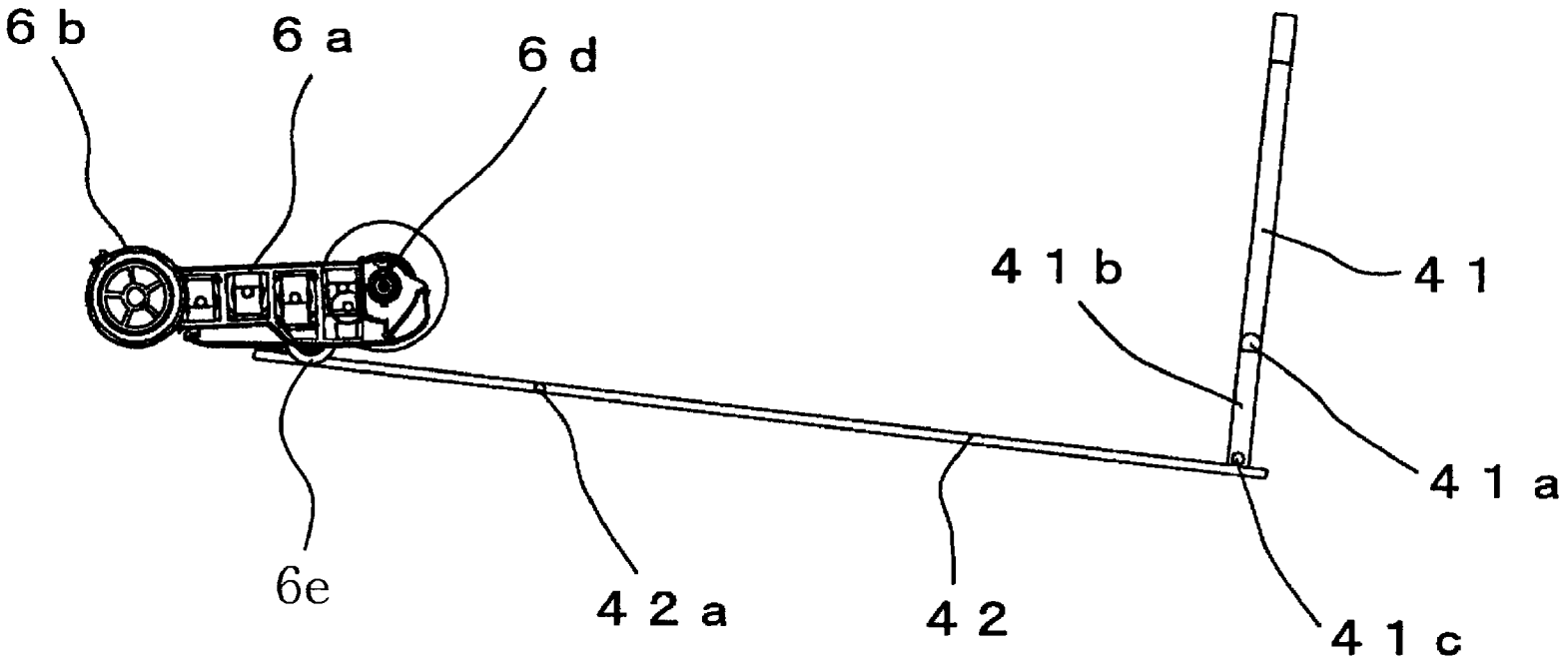
FIGS. 5A and 5B are explanatory views for explaining a relationship between the cover and the arm which are pivotably moved.
Figure 5B:
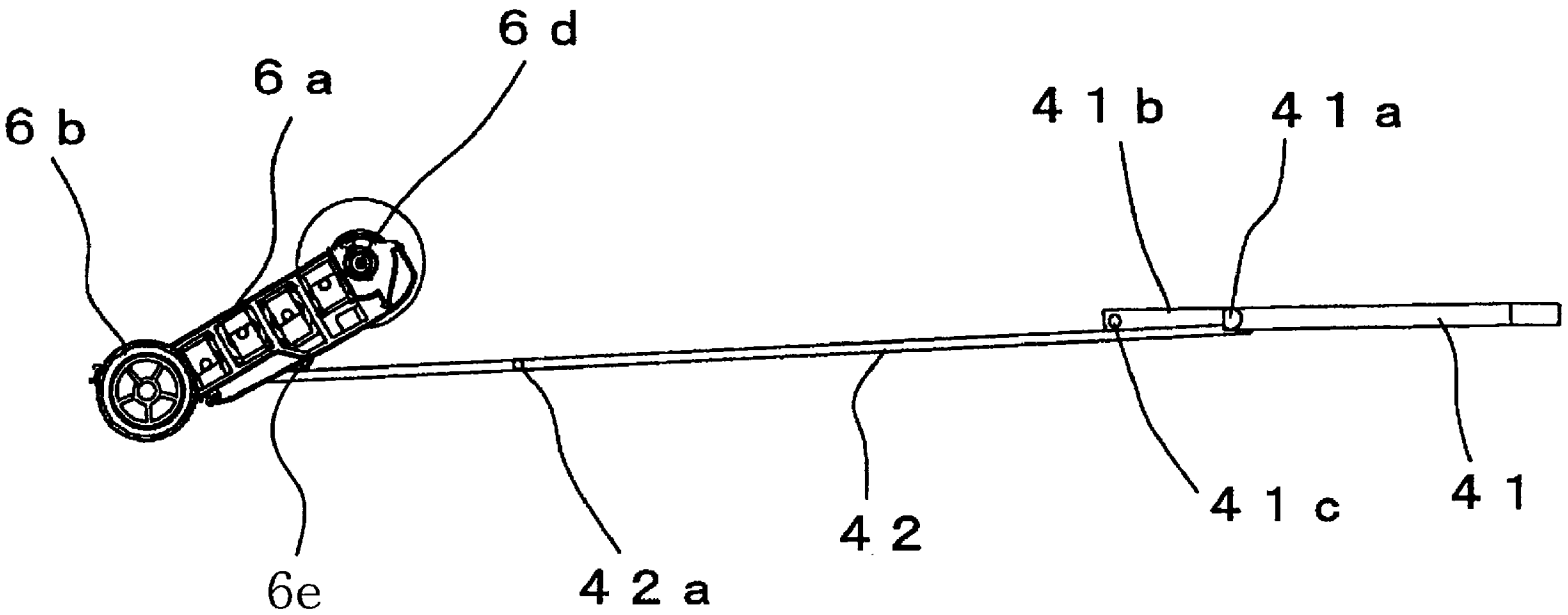

FIG. 4 is a perspective view showing the cover 41, a linking member 42, the arm 6*a*, and the sheet-feeding roller 6*b*. FIGS. 5A and 5B are explanatory views for explaining a relationship between the cover 41 and the arm 6*a* which are pivotably moved. As shown in FIGS. 4, 5A and 5B, on bottom opposite ends of the cover 41 in the rightward and leftward direction, there is formed a pair of pivot shafts 41*a*, 41*a* (only one of the pair of the pivot shafts 41*a*, 41*a* is shown in FIGS. 4, 5A and 5B) which are parallel to the support shaft 6*d* of the arm 6*a*.

The cover 41 is inserted into the opening 2*a* and the pivot shafts 41*a*, 41*a* of the cover 41 are supported by the device body 2. Therefore, the cover 41 is supported by the device body 2 so as to be pivotable about the pivot shafts 41*a*, 41*a*.

As shown in FIG. 1 and as indicated by the thin line shown in FIG. 3, when the cover 41 is in a closed position in which the cover stands vertically, the cover 41 covers or closes the sheet-discharge opening 10*a* (namely, the opening 2*a*). As shown in FIG. 2 and as indicated by a thick line shown in FIG. 3, when the cover 41 is in an open position (i.e., a position in which the sheet-discharge opening 10*a* and the opening 2*a* are not covered) in which the cover 41 is laid down almost horizontally, the cover 41 covers the opening 3*b* of the sheet-supply tray 3. When the cover 41 covers the opening 3*b*, dust or foreign objects can be prevented from entering into the sheet-supply tray 3. Therefore, it is possible to prevent the foreign objects from being fed together with the sheet P.

The cover 41 is supported so as to be pivotable between the closed position and the open position. The cover 41 may include a holding mechanism which applies a biasing force of a spring, etc., such that the cover 41 can be held in the closed position where the cover 41 stands vertically as long as external forces are not applied to the cover 41. Moreover, a biasing force of the arm 6*a* may be applied to the cover 41 such that the cover 41 can be held in the closed position.

As shown in FIGS. 4, 5A and 5B, an arm portion 41*b* is formed integrally with the cover 41. The arm portion 41*b* projects in a direction in which the flat-plate like cover 41 extends. On a distal end of the arm portion 41*b*, there is provided a pin 41*c* which projects in a direction parallel to a direction in which the pivot shafts 41*a*, 41*a* project.

In the device body 2, there is provided the linking member 42 having a bar shape which extends in a direction generally parallel to the feed direction of the sheet P and which is supported so as to swing about a swing pin 42*a* provided in a middle portion between opposite end portions thereof. The swing pin 42*a* is disposed so as to extend in a direction parallel to a direction in which the pivot shafts 41*a*, 41*a* extend. One of the opposite end portions of the linking member 42 is in contact with a lower portion of the pin 41*c* provided on the arm portion 41*b*.

The other of the opposite end portions of the linking member 42 is in contact with a protrusion 6*e* which protrudes from the arm 6*a* and which is formed integrally therewith. In the present embodiment, the protrusion 6*e* protrudes almost downward and contacts an upper side of the other of the opposite end portions of the linking member 42.

As shown in FIG. 5A, when the cover 41 is pivoted so as to stand vertically in the closed position, the one of the opposite end portions of the linking member 42 is pushed down via the arm portion 41*b* and the pin 41*c*. In this case, the linking member 42 swings about the swing pin 42*a* such that the other of the opposite end portions of the linking member 42 pushes up the protrusion 6*e*. Thus, against the biasing force applied to the arm 6*a*, the arm 6*a* is pivoted about the support shaft 6*d*, such that the sheet-feeding roller 6*b* is away from the sheet P put on the sheet-supply tray 3.

As shown in FIG. 5B, when the cover 41 is pivoted so as to be laid down horizontally in the open position, the other of the opposite end portions of the linking member 42 is pushed down via the protrusion 6*e* due to the biasing force of the arm 6*a*. In this case, the linking member 42 swings about the swing pin 42*a* so that the sheet-feeding roller 6*b* contacts the sheet P. In this state, a little space exists between the one of the opposite end portions of the linking member 42 and the pin 41*c* provided on the arm portion 41*b*.

Next, there will be described an operation of the image recording device 15 in the present embodiment. Initially, when the image is to be recorded on the A-4 size sheet P, the sheets P are put on the sheet-supply tray 3. Then, the sheet-supply tray 3 is attached to the device body 2. In this state, the pull portion 3*a* is pulled whereby the sheet-supply tray 3 has the projecting posture in which the projecting portion of the sheet-supply tray 3 projects outward from the device body 2 such that the opening 3*b* opens upward in an outside of the device body 2.

When the sheet-supply tray 3 is attached to the device body 2, a cam portion of the sheet-supply tray 3, not shown, contacts the protrusion 6*e* provided on the arm 6*a*, so that the arm 6*a* is pivoted. Accordingly, the sheet-feeding roller 6*b* is lift up. Then, in this state, the sheet-supply tray 3 is passed below the sheet-feeding roller 6*b* and attached to the device body 2. After the sheet-supply tray 3 is attached to the device body 2, the protrusion 6*e* provided on the arm 6*a* is separated from the cam portion of the sheet-supply tray 3. The arm 6*a* is pivoted, so that the sheet-feeding roller 6*b* is brought into contact with the sheet P.

The cover 41 is pivoted about the pivot shafts 41*a*, 41*a* to be positioned at the open position where the cover 41 covers the opening 3*b*, namely, the projecting portion of the sheet-supply tray 3. As shown in FIG. 5B, when the cover 41 is pivoted to the open position, the linking member 42 swings about the swing pin 42*a*, owing to the biasing force applied from the arm 6*a* to the linking member 42. Thus, the sheet-feeding roller 6*b* is brought into contact with the sheet P put on the sheet-supply tray 3.

When the image is recorded on the sheet P, the uppermost one of the sheets P put on the sheet-supply tray 3 is separated and fed, owing to the sheet-feeding roller 6*b* and the slant sheet-separate plate 8. The sheet P which has been separated from the sheets P put on the sheet-supply tray 3 is carried through the feed path 9 to the image recording mechanism 7. In the image recording mechanism 7, the ink is ejected from the recording head 4 according to image data which has been read by the image reading device 12, etc., so that the image is recorded on the sheet P. After the image is recorded in the image recording mechanism 7, the sheet P is carried along the feed path 9 to the sheet-discharge section 10.

The sheet P which has been carried to the sheet-discharge section 10 is discharged onto the sheet-discharge tray 10*b*. In this state, the leading end of the sheet P reaches over the cover 41, so that an entirety of the sheet P is put over the sheet-discharge tray 10*b* and the cover 41. Namely, the cover 41 can function as at least a part of a discharge tray.

When the A-4 size sheets P need to be charged after consumption of the sheets P put on the sheet-supply tray 3, initially, the cover 41 is pivoted from the open position to the closed position. Then, the opening 3*b* of the sheet-supply tray 3 is opened. Also, as shown in FIG. 5A, the one of the opposite end portions of the linking member 42 is pushed down by the pin 41*c* of the arm portion 41*b*, so that the linking member 42 swings about the swing pin 42*a*.

Owing to the swing of the linking member 42, the other of the opposite end portions of the linking member 42 pushes up the protrusion 6*e* provided on the arm 6*a*, so that the arm 6*a* is pivoted about the support shaft 6*d*. Accordingly, the sheet-feeding roller 6*b* is moved away from the sheets P or a putting surface of the sheet-supply tray 3 on which the sheets P to be put.

In this state, a space is created between the sheet-feeding roller 6*b* and the uppermost one of the sheets P or the putting surface of the sheet-supply tray 3. The sheets P are inserted from the opening 3*b* of the sheet-supply tray 3 along the sheets P put thereon or the putting surface thereof. It is easy to charge the sheets P since the leading ends of the sheets P which are inserted do not contact the sheet-feeding roller 6*b*.

For instance, if the leading ends of the sheets P contact the sheet-feeding roller 6*b*, some of the sheets P are likely to be bent because the biasing force of the arm 6*a* becomes a resistance force against the sheets P that are to be inserted. Further, some of the sheets P are easy to be bent if each sheet P is not stiff, thereby making it difficult to charge the sheets P.

Where the space is created between the sheet-feeding roller 6*b* and the uppermost one of the sheets P or the putting surface of the sheet-supply tray 3, it is easy to charge the sheets P even if the sheets P are easy to be bent. After the sheets P are charged, the cover 41 is pivoted about the pivot shafts 41*a*, 41*a* to be positioned at the open position where the cover 41 covers the opening 3*b*, namely, the projecting portion of the sheet-supply tray 3. Owing to this arrangement, the dust can be prevented from entering from the opening 3*b* into the sheet-supply tray 3.

As shown in FIG. 5B, when the cover 41 is pivoted to the open position, the linking member 42 swings about the swing pin 42*a*, owing to the biasing force of the arm 6*a*. Thus, the sheet-feeding roller 6*b* is brought into contact with the sheet P. When the sheet-feeding roller 6*b* is rotated, the sheets P can start to be fed, one by one, into the feed path 9 again.

After the sheets P are charged, if a recording operation is started with the cover 41 being left to be positioned at the closed position, namely, without being pivoted back to the open position, the other of the opposite end portions of the linking member 42 keeps pushing up the protrusion 6*e* provided on the arm 6*a* so that the sheet-feeding roller 6*b* is kept to be away from the sheets P. In this case, the image is not recorded on the sheet P because the sheet P is not fed from the sheet-supply tray 3 even if the sheet-feeding roller 6*b* is rotated.

If the sheet P were fed even when the cover 41 is positioned at the closed position, a sheet jam would be occurred since the sheet P carried to the sheet-discharge section 10 would strike against the cover 41. Therefore, for avoiding such a problematic sheet jam, the MFD 1 is configured such that the sheet P is not fed when the cover is positioned at the closed position.

As described above, in this embodiment, owing to a simple configuration of the MFD 1 in which the linking member 42 is provided, it is easy to charge the sheets P. Further, since this simple configuration of the MFD 1 enables the opening 3*b* of the sheet-supply tray 3 which projects outward from the device body 2 to be covered (by the cover 41), it is possible to prevent the dust from entering into the sheet-supply tray 3. When the sheet-supply tray 3 has the stay-in posture, a whole size of the MFD 1 is small because the sheet-supply tray 3 does not project from the device body 2. Therefore, only a small space is needed for installation of the MFD 1. It is noted that the image can be recorded on the small-size sheet P by putting the small-size sheets P on the sheet-supply tray 3 with the sheet-supply tray 3 being having the stay-in posture and with the cover 41 being positioned at the open position.

It is noted that a cover-arm interlock mechanism permits the arm 6*a* to pivot such that the sheet-feeding roller 6*b* contacts the sheet P put on the sheet-supply tray 3 when the cover 41 is positioned at the open position, and positions the arm 6*a* such that the sheet-feeding roller 6*b* is away from the sheet P put on the sheet-supply tray 3 when the cover 41 is positioned at the closed position. In other words, the cover-arm interlock mechanism permits the arm 6*a* to pivot in a direction that causes the sheet-feeding roller 6*b* to contact the sheet P put on the sheet-supply tray 3 when the cover 41 is positioned at the open position, and positions the arm 6*a* in a position that causes the sheet-feeding roller 6*b* to be away from the sheet P put on the sheet-supply tray 3 when the cover 41 is positioned at the closed position. Further, the cover-arm interlock mechanism includes the linking member 42.

Figure 6:
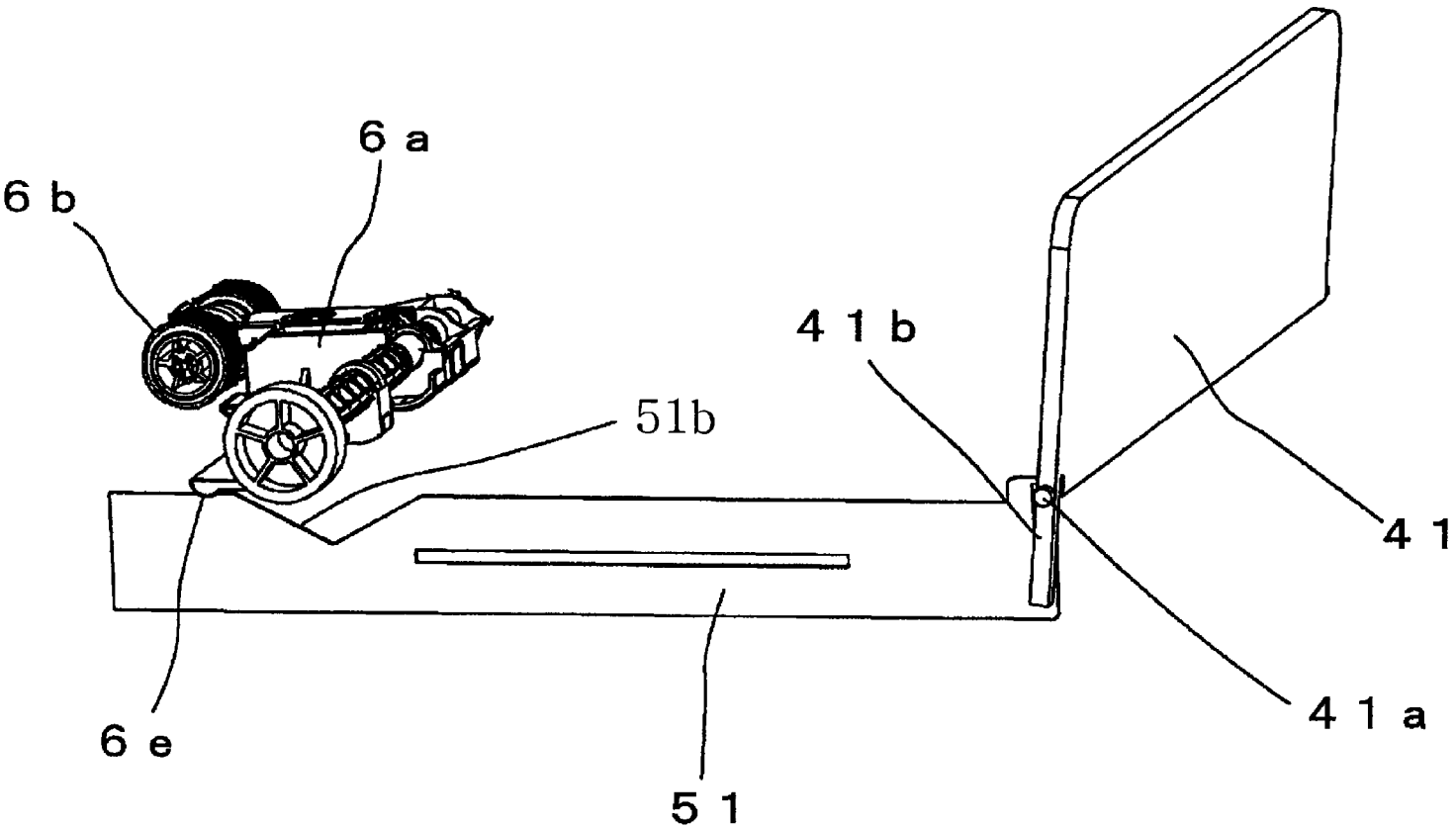
FIG. 6 is a perspective view showing a cover, a linking member, an arm, and a sheet-feeding roller which are provided in the MFD 1 as a second embodiment of the present invention.
Figure 7A:
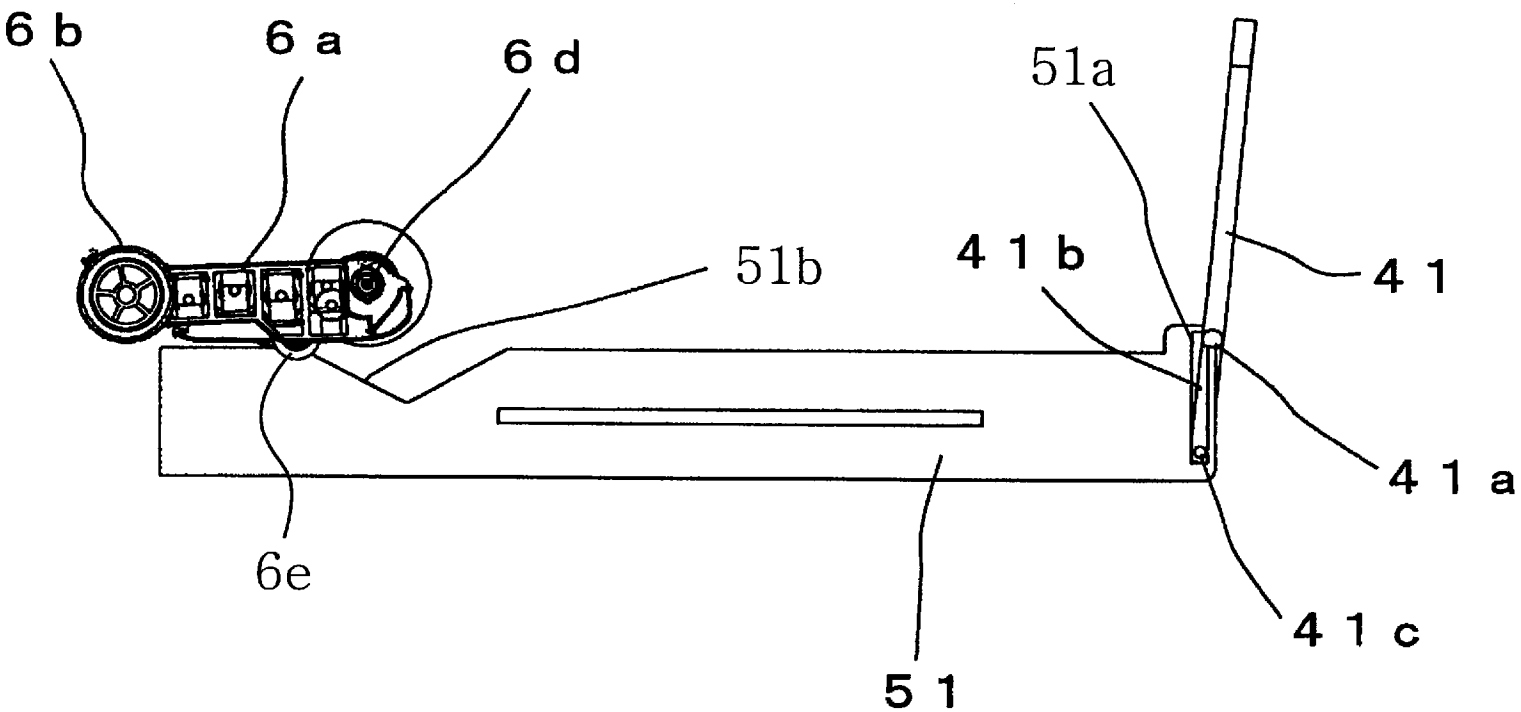
FIGS. 7A and 7B are explanatory views for explaining a relationship between the cover and the arm which are pivotably moved in the second embodiment.
Figure 7B:
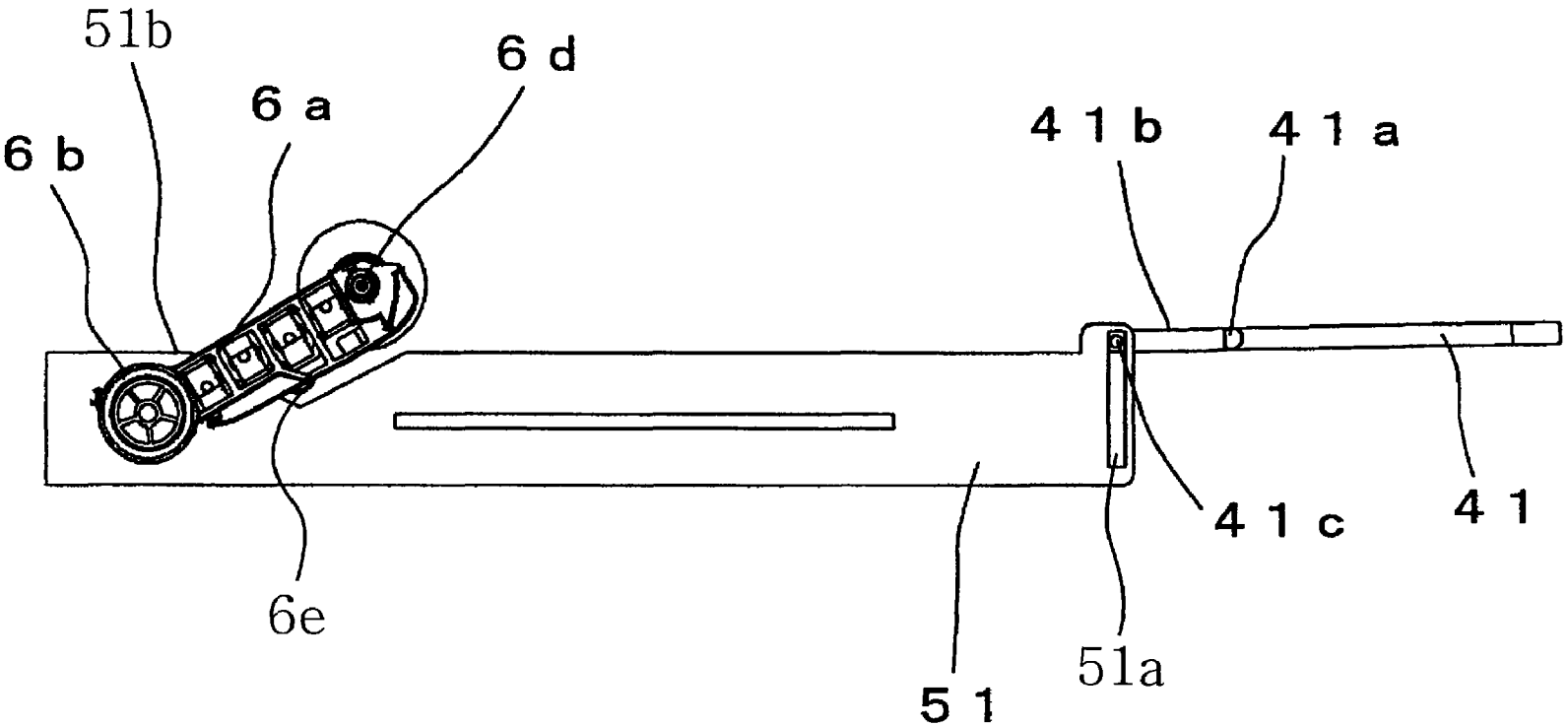

FIG. 6 is a perspective view showing the cover 41, a linking member 51, the arm 6*a* and the sheet-feeding roller 6*b* which are provided in the MFD 1 as a second embodiment of the present invention. FIGS. 7A and 7B are explanatory views for explaining a relationship between the cover 41 and the arm 6*a* which are pivotably moved in the second embodiment. It is noted that the same reference numerals as used in the first embodiment are used to designate the corresponding elements or parts of the second embodiment and the description thereof is omitted.

As shown in FIGS. 6, 7A and 7B, the plate-like linking member 51 is slidably provided in the feed direction of the sheet P (i.e., a specific direction). On one of the opposite end portions of the linking member 51, there is vertically formed an elongate hole 51*a*. The pin 41*c* of the cover 41 is slidably inserted into the elongate hole 51*a*.

On the other of the opposite end portions of the linking member 51, there is formed a cam portion 51*b* with which the protrusion 6*e* provided on the arm 6*a* is brought into contact. As shown in FIG. 7A, when the cover 41 is positioned at the closed position, the linking member 51 slides forward, owing to the pin 41*c*. In this state, the protrusion 6*e* provided on the arm 6*a* is brought into contact with the cam portion 51*b*, so that the cam portion 51*b* pushes up the protrusion 6*e*. Accordingly, the arm 6*a* is pivoted, against its biasing force, about the support shaft 6*d*, so that the sheet-feeding roller 6*b* is moved away from the sheets P.

As shown in FIG. 7B, when the cover 41 is positioned at the open position, the protrusion 6*e* provided on the arm 6*a* is received in a recess of the cam portion 51*b*, so that the protrusion 6*e* is away from the cam portion 51*b*. Accordingly, the arm 6*a* is pivoted, owing to its biasing force, about the support shaft 6*d*, so that the sheet-feeding roller 6*b* is brought into contact with the sheets P.

In the second embodiment, when the cover is positioned at the closed position, the opening 3*b* of the sheet-supply tray 3 opens, so that the sheets P can be charged therefrom. In this state, the linking member 51 slides forward, so that the cam portion 51*b* as a cam engages with the protrusion 6*e* functioning as a cam follower. Accordingly, the arm 6*a* is pivoted such that the sheet-feeding roller 6*b* is moved away from the uppermost one of the sheets P or the placing surface of the sheet-supply tray 3.

Therefore, a space is created between the sheet-feeding roller 6*b* and the uppermost one of the sheets P or the placing surface of the sheet-supply tray 3. The sheets P are inserted from the opening 3*b* of the sheet-supply tray 3 along the sheets P put thereon or the putting surface thereof. It is easy to charge the sheets P since the leading ends of the sheets P which are inserted do not contact the sheet-feeding roller 6*b*.

As shown in FIG. 7B, when the cover 41 is pivoted to the open position, the arm 6*a* is pivoted, owing to the biasing force thereof. Thus, the sheet-feeding roller 6*b* is brought into contact with the sheet P. When the sheet-feeding roller 6*b* is rotated, the sheets P can start to be fed, one by one, into the feed path 9 again.

As described above, in the second embodiment, owing to a simple configuration of the MFD 1 in which the linking member 51 is provided, it is easy to charge the sheets P. Further, since this simple configuration of the MFD 1 enables the opening 3*b* of the sheet-supply tray 3 which projects outward from the device body 2 to be covered (by the cover 41), it is possible to prevent the dust from entering into the sheet-supply tray 3.

It is noted that a cover-arm interlock mechanism permits the arm 6*a* to pivot such that the sheet-feeding roller 6*b* contacts the sheet P put on the sheet-supply tray 3 when the cover 41 is positioned at the open position, and positions the arm 6*a* such that the sheet-feeding roller 6*b* is away from the sheet P put on the sheet-supply tray 3 when the cover 41 is positioned at the closed position. In other words, the cover-arm interlock mechanism permits the arm 6*a* to pivot in a direction that causes the sheet-feeding roller 6*b* to contact the sheet P put on the sheet-supply tray 3 when the cover 41 is positioned at the open position, and positions the arm 6*a* in a position that causes the sheet-feeding roller 6*b* to be away from the sheet P put on the sheet-supply tray 3 when the cover 41 is positioned at the closed position. Further, the cover-arm interlock mechanism includes the linking member 51.

It is to be understood that the present invention is not limited to the details of the embodiments illustrated hereinabove, but may be embodied with various changes without departing from the spirit of the present invention.

What is claimed is:

1. An image recording apparatus comprising:

a body;

a supply tray which is attached to the body and on which a recording sheet is put;

a recording mechanism which is provided in a middle of a feed path defined in the body, and which records an image on the recording sheet fed along the feed path from the supply tray;

a feeding mechanism which includes (a) an arm pivotably supported at one of opposite ends thereof and (b) a feeding roller rotatably provided in the other of the opposite ends of the arm, and which is configured such that the recording sheet is fed toward the recording mechanism by rotating of the feeding roller held in contact with the recording sheet put on the supply tray;

a discharge opening which is provided in the body and through which the recording sheet is discharged from the recording mechanism;

a cover which is supported by the body so as to be pivotable between an open position at which the discharge opening is open and a closed position at which the discharge opening is closed; and a cover-arm interlock mechanism which permits the arm to pivot such that the feeding roller contacts the recording sheet put on the supply tray when the cover is positioned at the open position, and which positions the arm such that the feeding roller is away from the recording sheet put on the supply tray when the cover is positioned at the closed position.

2. The image recording apparatus according to claim 1, wherein the feed path of the recording sheet has a U-turn shape, and wherein the discharge opening is provided aside the supply tray.

3. The image recording apparatus according to claim 2, wherein the supply tray has a projecting portion which projects from the body, and wherein the cover is configured to cover the projecting portion of the supply tray when the cover is positioned at the open position.

4. The image recording apparatus according to claim 1, wherein the cover-arm interlock mechanism includes a linking member which is configured to move according to pivoting of the cover from the open position to the closed position so as to cause the arm to pivot in a direction in which the feeding roller is away from the recording sheet put on the supply tray.

5. The image recording apparatus according to claim 4, wherein the linking member is configured to swing about a portion thereof according to the pivoting of the cover from the open position to the closed position so as to cause the arm to pivot in the direction in which the feeding roller is away from the recording sheet put on the supply tray.

6. The image recording apparatus according to claim 5, wherein the linking member is configured to swing about a middle portion between opposite end portions thereof, and wherein one of the opposite end portions of the linking member engages with the cover and the other of the opposite end portions of the linking member engages with the arm.

7. The image recording apparatus according to claim 4, wherein the linking member is configured to slide in a specific direction according to the pivoting of the cover from the open position to the closed position so as to cause the arm to pivot in the direction in which the feeding roller is away from the recording sheet put on the supply tray.

8. The image recording apparatus according to claim 7, wherein one of opposite end portions of the linking member engages with the cover, and wherein the other of the opposite end portions of the linking member functions as a cam and engages with a portion of the arm which functions as a cam follower.

9. The image recording apparatus according to claim 1, wherein the supply tray is telescopic so as to have a projecting posture in which a portion of the supply tray projects from the body and a stay-in posture in which an entirety of the supply tray stays in the body.

10. The image recording apparatus according to claim 1, further comprising a discharge tray to which the recording sheet is to be discharged from the recording mechanism, and wherein the cover functions as at least a part of a discharge tray when positioned at the open position.

* * * * *